US007524220B2

(12) United States Patent
Fuse

(10) Patent No.: US 7,524,220 B2
(45) Date of Patent: Apr. 28, 2009

(54) WATER JET PROPELLER

(75) Inventor: Tomohiro Fuse, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 448 days.

(21) Appl. No.: 11/216,086

(22) Filed: Sep. 1, 2005

(65) Prior Publication Data

US 2006/0056956 A1 Mar. 16, 2006

(30) Foreign Application Priority Data

Sep. 10, 2004 (JP) ..... 2004-264185

(51) Int. Cl.
*B63H 11/08* (2006.01)
*B63H 11/103* (2006.01)
*F04D 29/40* (2006.01)

(52) U.S. Cl. ..... 440/38; 440/47; 415/173.1

(58) Field of Classification Search ..... 440/38, 440/40–43, 47; 60/221, 222; 415/128, 173.1–17, 415/196, 197
See application file for complete search history.

(56) References Cited

U.S. PATENT DOCUMENTS

| | | | | |
|---|---|---|---|---|
| 3,083,529 | A * | 4/1963 | Hemilton | 60/221 |
| 3,187,708 | A * | 6/1965 | Fox | 440/41 |
| 3,233,573 | A * | 2/1966 | Hamilton | 440/41 |
| 4,541,808 | A * | 9/1985 | Ono et al. | 440/42 |
| 4,583,913 | A * | 4/1986 | Yazaki | 415/196 |
| 4,917,637 | A * | 4/1990 | Soga et al. | 440/42 |
| 5,346,363 | A | 9/1994 | Stallman et al. | |
| 6,059,618 | A * | 5/2000 | Purnell et al. | 440/38 |
| 6,287,162 | B1 | 9/2001 | Freitag et al. | |
| 6,383,040 | B2 * | 5/2002 | Ito et al. | 440/38 |
| 6,431,925 | B1 * | 8/2002 | Ito et al. | 440/38 |
| 6,558,211 | B2 * | 5/2003 | Freitag et al. | 440/42 |
| 6,659,816 | B2 * | 12/2003 | Fuse | 440/38 |
| 6,682,373 | B2 * | 1/2004 | Matsuda et al. | 440/38 |
| 7,223,138 | B2 * | 5/2007 | Fuse | 440/38 |

FOREIGN PATENT DOCUMENTS

| | | | |
|---|---|---|---|
| JP | 60-060397 U | | 4/1985 |
| JP | 60110598 A | * | 6/1985 |
| JP | 60213599 A | * | 10/1985 |
| JP | 02-124394 | | 5/1990 |

(Continued)

*Primary Examiner*—Ajay Vasudeva
(74) *Attorney, Agent, or Firm*—Birch, Stewart, Kolasch & Birch, LLP

(57) ABSTRACT

To provide a water jet propeller that enables an efficient flow of water from a water flow duct to an impeller housing even if an inner periphery of the impeller housing has an inside diameter smaller than the inside diameter of a rear end portion of the water flow duct. A water jet propeller has a stator disposed at a rear end portion of an impeller housing. An impeller is disposed inside the impeller housing. The water jet propeller expels a water jet by rotating the impeller. The water jet propeller further has the impeller disposed so as to circumvent a front end portion of an inner periphery of the impeller housing. The impeller housing includes a liner disposed over a region facing the impeller and representing the inner periphery of the impeller housing, except for the front end portion. The front end portion is formed to have an inside diameter that gradually increases forwardly.

10 Claims, 11 Drawing Sheets

FOREIGN PATENT DOCUMENTS

| | | | | |
|---|---|---|---|---|
| JP | 05139379 | A | * | 6/1993 |
| JP | 05139380 | A | * | 6/1993 |
| JP | 06040390 | A | * | 2/1994 |
| JP | 07017484 | A | * | 1/1995 |
| JP | 07196087 | A | * | 8/1995 |
| JP | 9-99897 | A | | 4/1997 |
| JP | 2003200894 | A | * | 7/2003 |

* cited by examiner

WATER JET PROPELLER

CROSS-REFERENCE TO RELATED APPLICATIONS

This nonprovisional application claims priority under 35 U.S.C. § 119(a) on Patent Application No. 2004-264185, filed in Japan on Sep. 10, 2004, the entirety of which is incorporated herein by reference.

BACKGROUND OF THE INVENTION

1. Field of the Invention

The present invention relates to a water jet propeller having an impeller disposed inside an impeller housing. In particular, the present invention relates to making the impeller rotate to expel a water jet.

2. Description of Background Art

Conventionally, a water jet propeller is mounted in a rear portion of a hull. The water jet propeller draws in water from a hull bottom by driving the impeller with an engine and expelling the water drawn therein rearward, thereby propelling a watercraft (see, for example, Japanese Patent Laid-open No. Hei 9-99897).

Japanese Patent Laid-open No. Hei 9-99897 will be described with reference to the FIG. 11. FIG. 11 is a view for illustrating a basic construction of a water jet propeller according to the background art.

A water jet propeller 200 includes an impeller housing 203, a stator 204, a nozzle 205 and a steering nozzle 207. The impeller housing 203 has a cylindrical shape and is disposed in a rear portion 202 of a hull 201. The stator 204 has a cylindrical shape and is disposed at a rear end portion 203*a* of the impeller housing 203. The nozzle 205 has a diameter that decreases rearwardly. The nozzle 205 is disposed at a rear end portion 204*a* of the stator 204. The steering nozzle 207 is pivotably mounted to the nozzle 205 via upper and lower pins 206, 206, so that the steering nozzle 207 can swing in a crosswise direction.

An impeller 208 is disposed inside the impeller housing 203. A rotational shaft 209 of the impeller 208 extends into the stator 204. The extended rotational shaft 209 is rotatably mounted in the stator 204 via bearings 211, 211.

In the water jet propeller 200 according to the background art, the impeller 208, which is disposed inside the impeller housing 203, is rotated by an engine (not shown). A water jet is thereby expelled from a rear end portion 207*a* of the steering nozzle 207 to propel the hull 201. The steering nozzle 207 can be swung to the right or to the left about an axis of the upper and lower pins 206, 206, thereby allowing the hull 201 to turn right or left.

A water jet propeller according to the background art includes a stainless steel liner applied to an entire area from a front end portion 203*c* to a rear end portion 203*d* of the inner periphery 203*b* of the impeller housing 203. The stainless steel liner offers outstanding wear resistance. Therefore, the stainless steel liner has been used in the background art as an example of a solution to decrease wear of an inner periphery 203*b* of the impeller housing 203 that can occur during rotation of the impeller 208.

However, applying a stainless steel liner to the entire area from the front end portion 203*c* to the rear end portion 203*d* of the inner periphery 203*b* of the impeller housing 203 causes the liner to have an inside diameter that is uniform throughout the entire area from the front end portion 203*c* to the rear end portion 203*d*. Accordingly, if, for example, the inner periphery 203*b* of the impeller housing 203 is made smaller than an inside diameter of a rear end portion 212*a* of a water flow duct 212, a step is formed between the rear end portion 212*a* of the water flow duct 212 and the front end portion 203*c* of the inner periphery 203*b*.

The step formed between the rear end portion 212*a* of the water flow duct 212 and the front end portion 203*c* of the inner periphery 203*b* blocks the flow of water when there is an inflow of water from the water flow duct 212 into the impeller housing 203. Since the water flow is blocked off by the step, it is difficult to ensure an efficient flow of water into the impeller housing 203 from the water flow duct 212.

SUMMARY OF THE INVENTION

It is therefore an object of the present invention to provide a water jet propeller that enables an efficient flow of water from a water flow duct to an impeller housing even if an inner periphery of the impeller housing has an inside diameter smaller than the inside diameter of a rear end portion of the water flow duct.

To achieve the foregoing object, according to a first aspect of the present invention, there is provided a water jet propeller including: a cylindrically shaped impeller housing disposed in a rear portion of a hull; an impeller disposed inside the impeller housing; a cylindrically shaped stator disposed at a rear end portion of the impeller housing; and a nozzle disposed at a rear end portion of the stator, the nozzle having a diameter that gradually diminishes rearwardly.

The water jet propeller propels the hull by expelling a water jet from a rear end portion of the nozzle using water that flows in from a water flow duct forward of the impeller housing by rotating the impeller. The water jet propeller includes the following points. Specifically, the impeller is disposed so as to circumvent a front end portion of an inner periphery of the impeller housing; the impeller housing includes a liner disposed over a region facing the impeller and representing the inner periphery of the impeller housing, except for the front end portion; and the front end portion is formed to have an inside diameter that gradually increases forwardly.

The liner is disposed on the inner periphery of the impeller housing at the region that faces the impeller. Therefore, wear resistance of the impeller housing can be achieved by forming the liner using a material that offers outstanding wear resistance.

It should be noted herein that the region of the inner periphery of the impeller housing facing the impeller greatly affects pump performance of the water jet propeller (that is, a water pump). Accordingly, it becomes possible, for example, to choose pump performance that matches ease of use on the part of the user by varying the inside diameter of the region facing the impeller.

If the inside diameter of the region facing the impeller is varied, a difference between the inside diameter of the water flow duct forward of the impeller housing and the inside diameter of the region facing the impeller results. A step is therefore formed at a connection portion of each of the adjoining members.

Accordingly, according to the first aspect of the present invention, the liner is disposed on a region of the inner periphery of the impeller housing except for the front end portion of the impeller housing. In addition, the inside diameter of the front end portion is formed to gradually increase forwardly.

This permits the following arrangement when the inner periphery of the impeller housing is made smaller than the inside diameter of the rear end portion of the water flow duct. The arrangement is, specifically, that the inside diameter at a front edge of the impeller housing coincides with the inside diameter of the rear end portion of the water flow duct so that no step is formed between the rear end portion of the water flow duct and the front end portion of the impeller housing.

According to a second aspect of the present invention, the water jet propeller includes a region (of a predetermined length) having an inside diameter identical to the inside diameter of the liner. The region is formed immediately before the liner at the front end portion.

Forming a region having an inside diameter identical to the inside diameter of the liner immediately before the liner allows manufacturing errors to be absorbed. This makes it possible to provide the region immediately before the liner with the same inside diameter as the liner.

According to the first aspect of the present invention, the impeller housing includes a wear-resistant liner applied to the inner periphery thereof. Good wear resistance is thereby achieved for the impeller housing. In addition, the arrangement is made such that no step is formed between the rear end portion of the water flow duct and the front end portion of the impeller housing when the inner periphery of the impeller housing is made smaller than the inside diameter of the rear end portion of the water flow duct. This achieves an efficient inflow of water from the water flow duct to the impeller housing.

According to the second aspect of the present invention, a region having an inside diameter identical to the inside diameter of the liner is formed immediately before the liner. This absorbs manufacturing errors, thereby making the connection between the front end portion and the liner smooth.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A specific embodiment to which the present invention is applied will be described below with reference to the accompanying drawings. For the purpose of this specification, "front," "rear," "left," and "right" denote corresponding directions as viewed from an operator of a watercraft. In addition, "Fr" denotes forward, "Rr" denotes rearward, "L" denotes leftward, and "R" denotes rightward.

Figure 1:
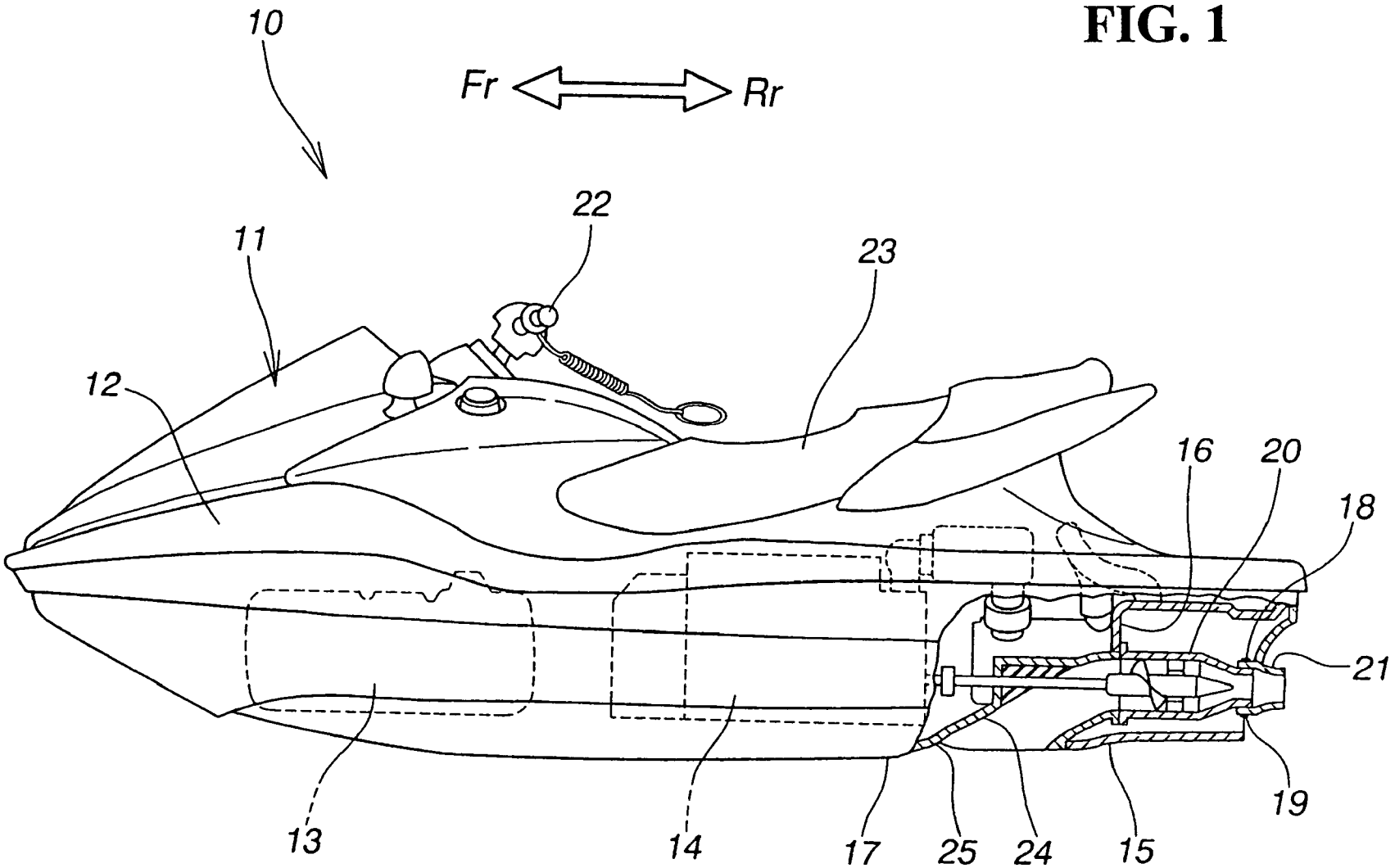
FIG. 1 is a side elevational view showing a personal watercraft including a water jet propeller according to a preferred embodiment of the present invention.

FIG. 1 is a side elevational view showing a personal watercraft including a water jet propeller according to a preferred embodiment of the present invention. A personal watercraft 10 includes a fuel tank 13, an engine 14, a water jet propeller chamber 16 and a water jet propeller 20. The fuel tank 13 is mounted in a front portion 12 of a hull 11. The engine 14 is disposed rearward of the fuel tank 13. The water jet propeller chamber 16 is disposed at a stern (a rear portion of the hull) 15 located rearward of the engine 14. The water jet propeller 20 is disposed inside the water jet propeller chamber 16.

The personal watercraft 10 further includes a steering nozzle 21, a steering handlebar 22 and a seat 23. The steering nozzle 21 is disposed rearward of the water jet propeller 20 and is pivotably mounted to swing to the right and left via upper and lower pins 18, 19. The steering handlebar 22 is provided for swingably operating the steering nozzle 21 the steering handlebar 22 is disposed upward of the fuel tank 13. The seat 23 is disposed rearward of the steering handlebar 22.

Figure 2:
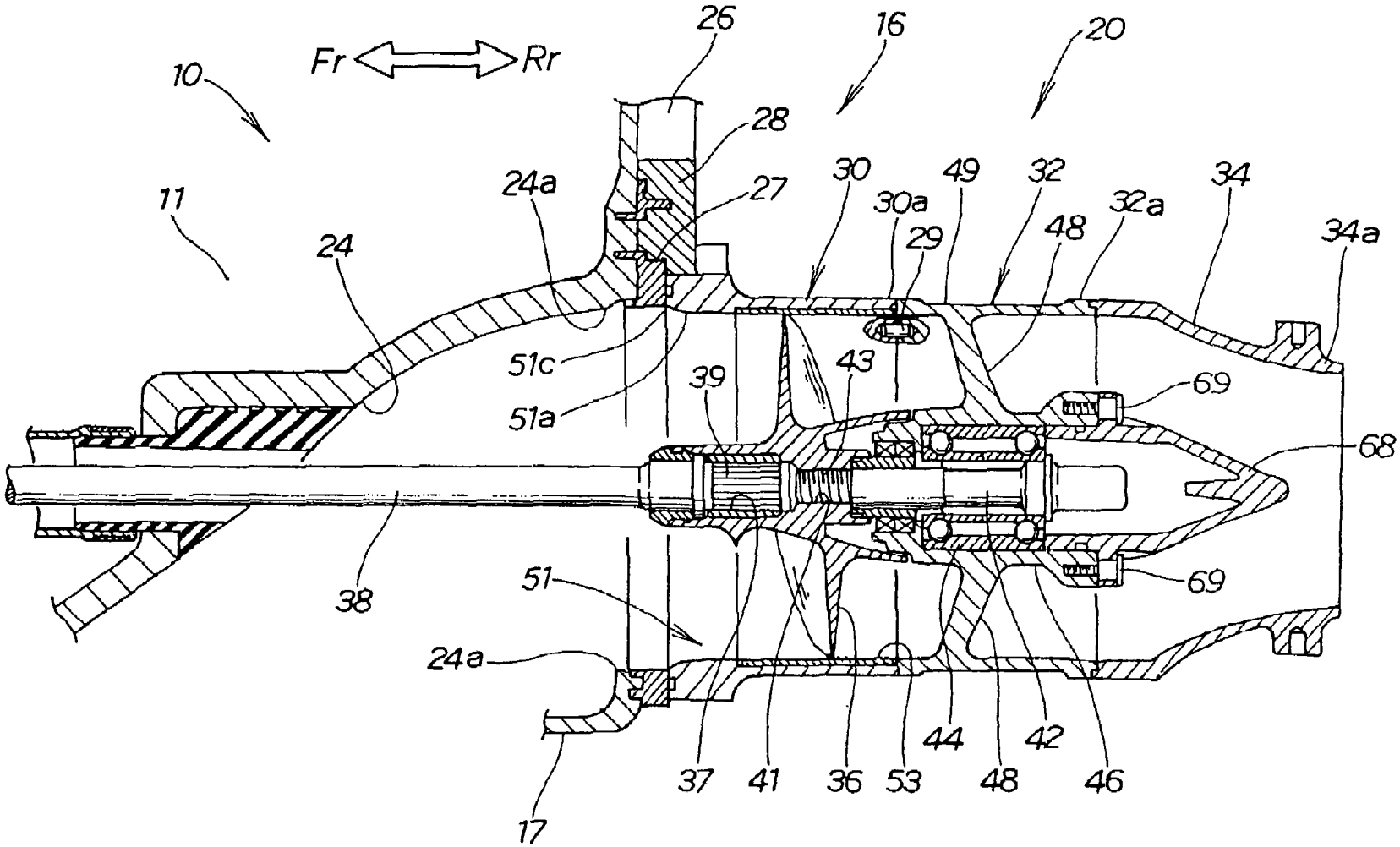
FIG. 2 is a cross-sectional view showing the water jet propeller according to the preferred embodiment of the present invention.

FIG. 2 is a cross-sectional view showing the water jet propeller according to the preferred embodiment of the present invention. The water jet propeller 20 is constructed as follows. Specifically, the stern 15 of the hull 11 includes an intake port 25 (shown in FIG. 1) of a water flow duct 24 that opens to a hull bottom 17. The water flow duct 24 extends to the water jet propeller chamber 16. First and second bases 27, 28 are mounted in a wall portion 26 of the water jet propeller chamber 16. A cylindrical impeller housing 30 is disposed on the first and second bases 27, 28. A cylindrical stator 32 is disposed on a rear end portion 30*a* of the impeller housing 30. Furthermore, a nozzle 34 is disposed at a rear end portion 32*a* of the stator 32. The nozzle 34 has a diameter that gradually diminishes rearwardly.

Furthermore, an impeller 36 is disposed inside the impeller housing 30. Female splines 37 of the impeller 36 are engaged onto male splines 39 of a drive shaft 38 to achieve a splined coupling between the impeller 36 and the drive shaft 38. A front end of the drive shaft 38 is coupled to the engine 14 (see FIG. 1). A threaded connection is then made between internal threads 41 of the impeller 36 and external threads 43 of a support shaft 42. The support shaft 42 is rotatably mounted in a bearing 46 of the stator 32 via a bearing 44.

More specifically, the impeller 36 and the support shaft 42 are integrated with each other by making the threaded connection between the internal threads 41 of the impeller 36 and the external threads 43 of the support shaft 42.

This arrangement, in which the support shaft 42 is rotatably mounted in the bearing 46 of the stator 32 via the bearing 44, means that the impeller 36 is rotatably mounted in the stator 32. The impeller 36 is disposed, or accommodated, in the impeller housing 30. The bearing 46 is secured to a casing 49 of the stator 32 via a plurality of stays 48. A cap 68 is mounted to a rear end portion of the bearing 46 with bolts 69. The stays 48 are members extending radially from an outer periphery of the bearing 46 to the casing 49 of the stator 32.

Figure 3:
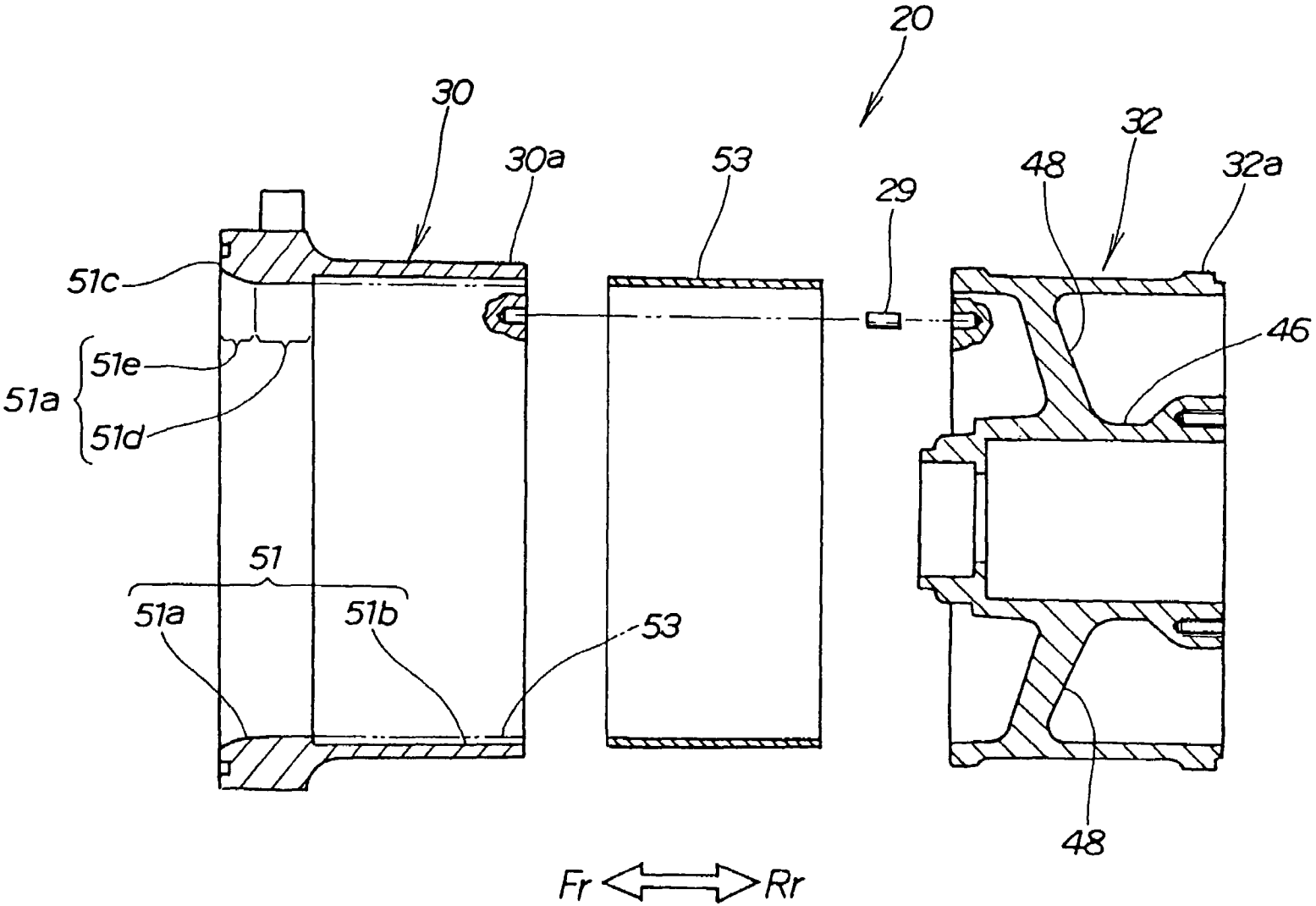
FIG. 3 is a cross-sectional view showing an impeller housing, a liner, and a stator of the water jet propeller according to the preferred embodiment of the present invention.

FIG. 3 is a cross-sectional view showing disassembled states of the impeller housing, a liner, and the stator of the water jet propeller according to the preferred embodiment of the present invention. An imaginary line in the impeller housing 30 of FIG. 3 represents the liner 53 when the liner 53 is insert-molded in the impeller housing 30.

In the water jet propeller 20, the impeller 36 (see FIG. 2) is disposed so as to circumvent a front end portion 51*a* of an inner periphery 51 of the impeller housing 30. Furthermore, the liner 53 is disposed over a region 51*b* facing the impeller 36. The region 51*b* forms a portion of the inner periphery 51 of the impeller housing 30 except for the front end portion 51*a*.

The front end portion 51*a* includes a region 51*d* and a region 51*e*. The region 51*d* is located immediately before the liner 53 (that is, a region having the same inside diameter as the liner). The region 51*e* extends between the region 51*d* and a front edge 51*c* of the inner periphery 51 (a region on the side adjacent to the front edge). The region 51*d* immediately before the liner 53 extends over a predetermined length formed to have an inside diameter identical to the inside diameter of the liner 53. The region 51*e* on the front edge side is formed to have an inside diameter that gradually increases forwardly, or toward the front edge 51*c*.

Forming the region 51*d* having the same inside diameter as the liner 53 immediately before the liner 53 allows manufacturing errors to be absorbed. This makes it possible to provide the region 51*d* immediately before the liner 53 with the same inside diameter as the liner 53.

This arrangement helps make a connection between the front end portion 51*a* and the liner 53 positively smooth. More specifically, an exemplary method for providing the liner 53 for the impeller housing 30 may be to mold the liner 53 into position (insert molding) when the impeller housing 30 is cast. After the liner 53 has been molded in (insert-molded in) the impeller housing 30, the inner periphery of the liner 53 can be machined to a desired shape. The inner periphery of the region 51*d* immediately before the liner 53 is machined at the same time as this machining. Any manufacturing error (that is, a casting error) can thereby be positively absorbed.

It is then possible to secure the same inside diameter for the region 51*d* immediately before the liner 53 as the inside diameter of the liner 53. As a result, the connection between the front end portion 51*a* and the liner 53 can be made positively smooth. In addition, the inside diameter of the region 51*e* on the front edge side is made to increase gradually toward the front edge 51*c*. The region 51*e* on the front edge side is thereby formed to have a curved cross section.

By gradually increasing the inside diameter of the region 51*e* toward the front edge 51*c* as described above, the front edge 51*c* of the inner periphery 51 is formed to have the same inside diameter as the first base 27 shown in FIG. 2. The first base 27 has an inside diameter identical to the inside diameter of a rear end portion 24*a* of the water flow duct 24.

Accordingly, it becomes possible, for example, to choose pump performance that matches ease of use on the part of the user by varying the inside diameter of the region facing the impeller 36, that is, the inside diameter of the liner 53.

The liner 53 can be a stainless steel cylindrical member molded (insert-molded) in the impeller housing 30, for example. A positioning pin 29 is used when the rear end portion 30*a* of the impeller housing 30 is mounted to the stator 32. Assembling the stator 32 to the impeller housing 30 is thereby simplified.

Referring back to FIG. 2, according to the water jet propeller 20, the impeller 36 is rotated by rotating the drive shaft 38 with the engine 14 (see FIG. 1). Rotation of the impeller 36 allows water to be drawn into the water flow duct 24 through the intake port 25 (see FIG. 1). The water thus drawn in is then further drawn into the impeller housing 30 via the rear end portion 24*a* of the water flow duct 24.

Water in the impeller housing 30 is sent to the nozzle 34 via the stator 32 through rotation of the impeller 36. A water jet is then expelled from a rear end portion 34*a* of the nozzle 34 rearwardly. Expelling the water jet rearwardly from the rear end portion 34*a* of the nozzle 34 propels the personal watercraft 10 (shown in FIG. 1).

Figure 4:
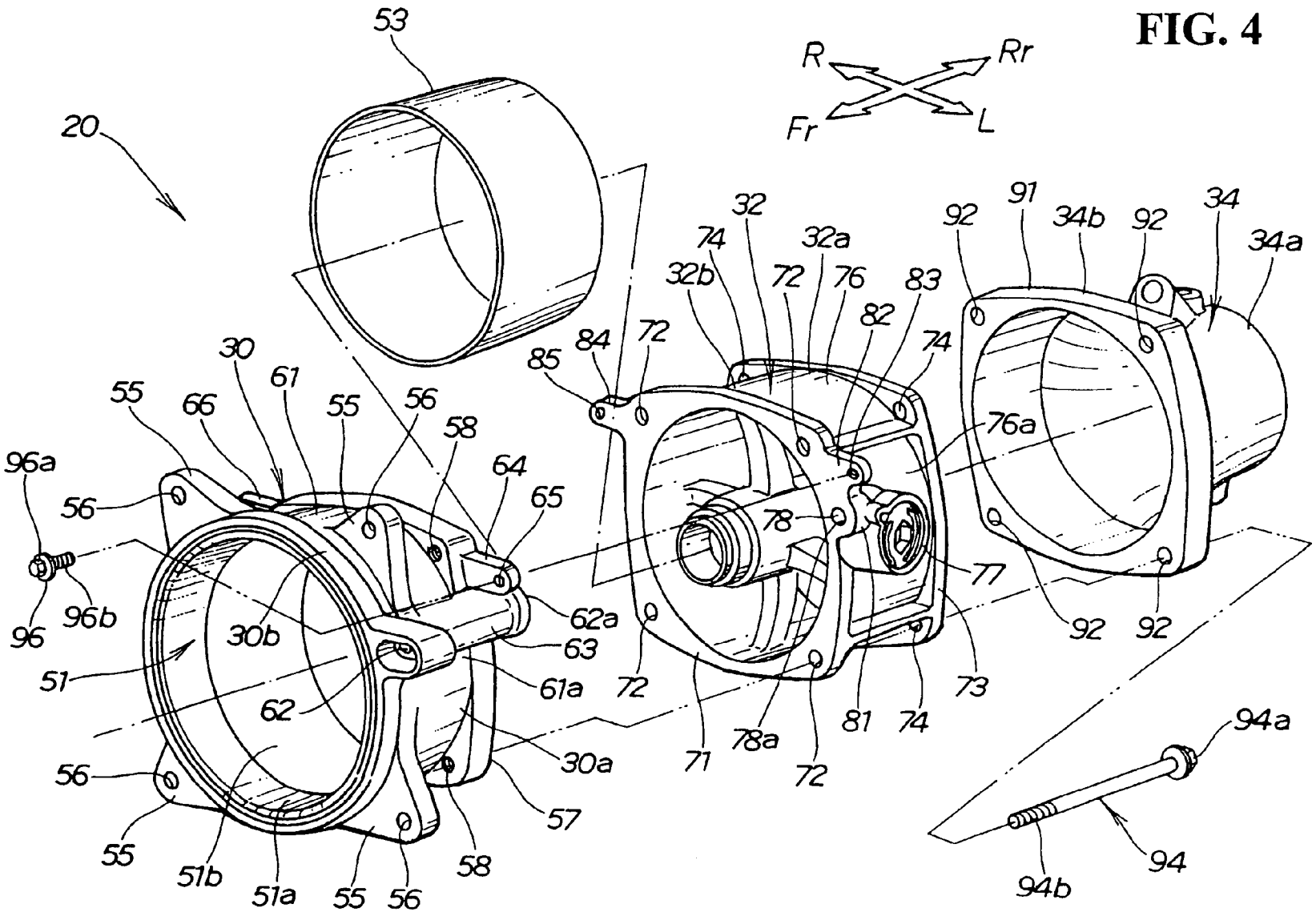
FIG. 4 is an exploded perspective view showing the water jet propeller according to the preferred embodiment of the present invention.

FIG. 4 is an exploded perspective view showing the water jet propeller according to the preferred embodiment of the present invention. The impeller housing 30 is a cylindrically formed member. Four mounting brackets 55 are provided at predetermined intervals on a front end portion 30*b*. Each of the mounting brackets 55 is provided with a mounting hole 56. A rear flange 57 is formed on the rear end portion 30*a*. Mounting threaded holes 58 (shown in FIG. 4 are only the left-hand side mounting threaded holes 58, 58) are formed at all four corners of the rear flange 57.

The impeller housing 30 is constructed as follows. Specifically, a left-hand side portion 61*a* of an outer wall 61 includes a water guide path 62. A wall portion 63 forming the water guide path 62 includes a left-hand side second protruding tab (a second protruding tab) 64. The left-hand side second protruding tab 64 includes a mounting hole 65. A right-hand side portion (not shown) of the outer wall 61, or a side opposite to the left-hand side second protruding tab 64, includes a right-hand side second protruding tab 66 (see FIG. 6). The right-hand side second protruding tab 66 includes a mounting hole 67 (see FIG. 6).

The liner 53 is, as an example, a stainless steel cylindrical member molded (insert-molded) in the impeller housing 30 when the impeller housing 30 is cast. Forming the liner 53 from stainless steel offers outstanding wear resistance and helps prevent the inner periphery 51 of the impeller housing 30 from wearing as a result of rotation of the impeller 36 (see FIG. 2).

The stator 32 is a cylindrically formed member. A front end portion 32*b* includes a front flange 71. The front flange 71 is provided with mounting holes 72 disposed at all four corners thereof. The rear end portion 32*a* of the stator 32 includes a rear flange 73. The rear flange 73 is provided with mounting holes 74 (the mounting hole 74 at the right bottom corner is not shown) disposed at all four corners thereof. The mounting holes 72 in the front flange 71 and the mounting holes 74 in the rear flange 73 are formed concentrically with each other.

The stator 32 is constructed as follows. Specifically, a left-hand side portion 76*a* of an outer wall 76 includes a water take-out portion 77. The water take-out portion 77 is provided with a water take-out path 78. A wall portion 81 forming the water take-out path 78 includes a left-hand side first protruding tab (a first protruding tab) 82. The left-hand side first protruding tab 82 is provided with a mounting threaded hole 83. A right-hand side portion (not shown) of the outer wall 76, or a side opposite to the left-hand side first protruding tab 82, includes a right-hand side first protruding tab 84 (see also FIG. 6). The right-hand side first protruding tab 84 includes a mounting threaded hole 85 (see also FIG. 6).

The left-hand side first protruding tab 82 is disposed opposingly to the left-hand side second protruding tab 64. The right-hand side first protruding tab 84 is disposed opposingly to the right-hand side second protruding tab 66 (see FIG. 6).

The water take-out path 78 is a path, through which water in the stator 32 is taken out externally via the water take-out portion 77 and then guided into the water guide path 62. The water guided up to the water guide path 62 is guided to the engine through a path not shown, used as coolant for cooling the engine.

Some known types of water jet propellers 20 integrate the impeller housing 30 with the stator 32. When the impeller housing 30 is molded integrally with the stator 32, the resultant molded member becomes relatively large in size and has a complicated shape. Accordingly, integrally molding the impeller housing 30 with the stator 32 requires a mold that is large in size and complicated in shape, thus resulting in a cost of equipment being increased.

The impeller housing 30 and the stator 32 are therefore divided into two parts so that each of the members 30, 32 is built compactly and shaped simply. It is then possible to make molds for molding the impeller housing 30 and the stator 32 small and less complicated in shape, thus suppressing the equipment cost.

The nozzle 34 is attached to the rear end portion 32*a* of the stator 32. The nozzle 34 is formed to have a diameter that gradually diminishes from a front end portion 34*b* toward the rear end portion 34*a*. The front end portion 34*b* includes a front flange 91. The front flange 91 is provided with mounting holes 92 disposed at all four corners thereof.

The front end portion 32*b* of the stator 32 is pressed up against the rear end portion 30*a* of the impeller housing 30. The mounting holes 72 in the front flange 71 are thereby aligned with corresponding ones of the mounting threaded holes 58 in the rear flange 57.

Furthermore, pressing the front end portion 32*b* of the stator 32 up against the rear end portion 30*a* of the impeller housing 30 results in the following. Specifically, a rear opening end 62*a* of the water guide path 62 is connected to an opening end 78*a* of the water take-out path 78, thus bringing the water guide path 62 into communication with the water take-out path 78. At the same time, the left-hand side second protruding tab 64 is abutted against the left-hand side first protruding tab 82, and the right-hand side second protruding tab 66 (see FIG. 6) is abutted against the right-hand side first protruding tab 84.

Similarly, the front end portion 34*b* of the nozzle 34 is pressed up against the rear end portion 32*a* of the stator 32. The mounting holes 92 in the front flange 91 are then aligned with corresponding ones of the mounting holes 74 in the rear flange 73. Connection bolts (first bolts) 94 are then inserted into the mounting holes 92 in the front flange 91, the mounting holes 74 in the rear flange 73, the mounting holes 72 in the front flange 71 and the mounting threaded holes 58 in the rear flange 57.

The connection bolt 94 includes a head portion 94*a* disposed at a base end portion and a threaded portion 94*b* at a leading end portion. The threaded portion 94*b* has external threads that can be screw-threadably engaged with the mounting threaded hole 58.

The left-hand side second protruding tab 64 is abutted against the left-hand side first protruding tab 82. The mounting threaded hole 83 in the left-hand side first protruding tab 82 is thereby aligned with the mounting hole 65 in the left-hand side second protruding tab 64. A lock bolt 96 is then inserted in the mounting hole 65 in the left-hand side second protruding tab 64 and the mounting threaded hole 83 in the left-hand side first protruding tab 82. The lock bolt 96 includes a head portion 96*a* disposed at a base end portion and a threaded portion 96*b* at a leading end portion. The threaded portion 96*b* has external threads that can be screw-threadably engaged with the mounting threaded hole 83.

Figure 5:
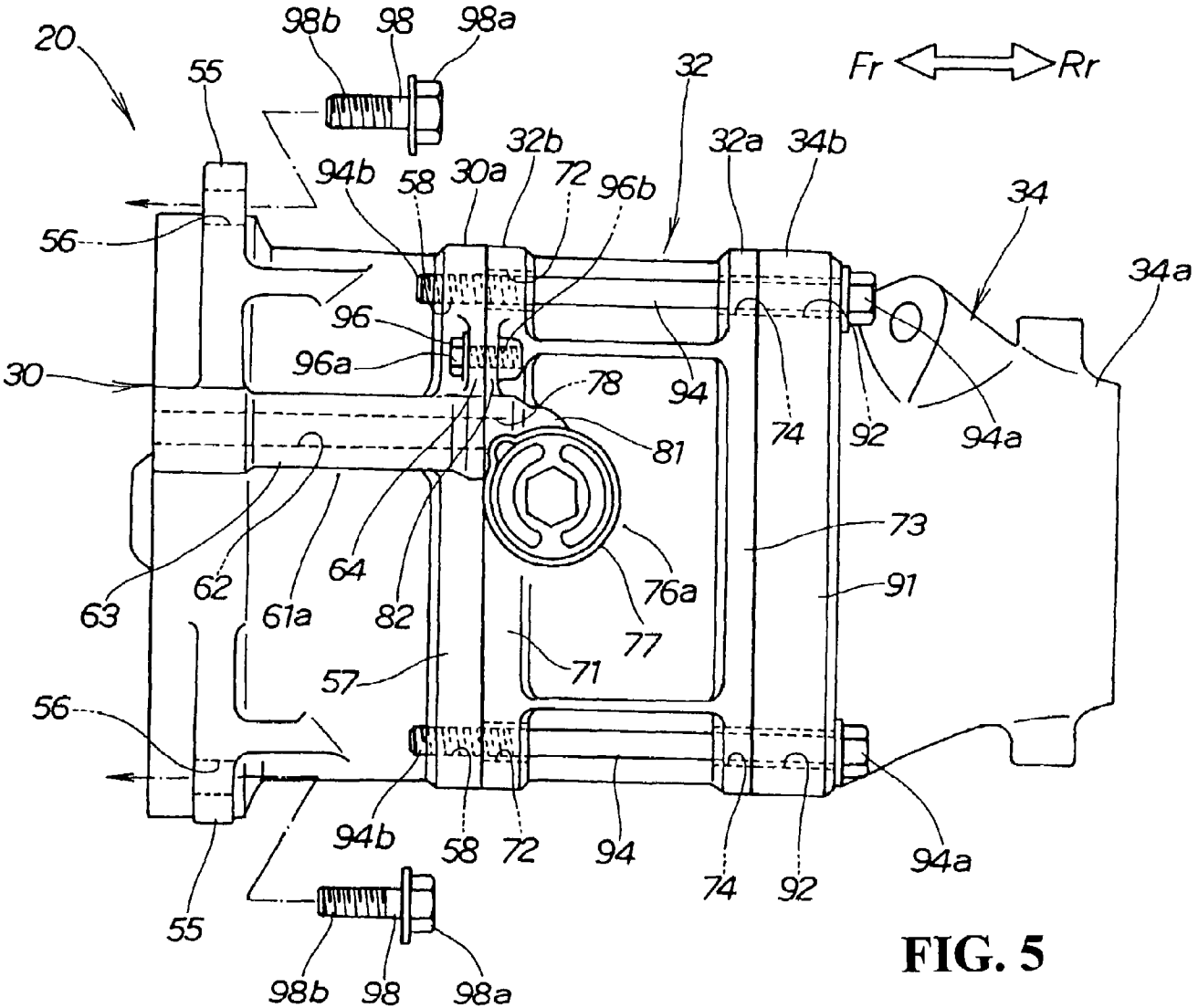
FIG. 5 is a side elevational view showing the water jet propeller according to the preferred embodiment of the present invention.
Figure 6:
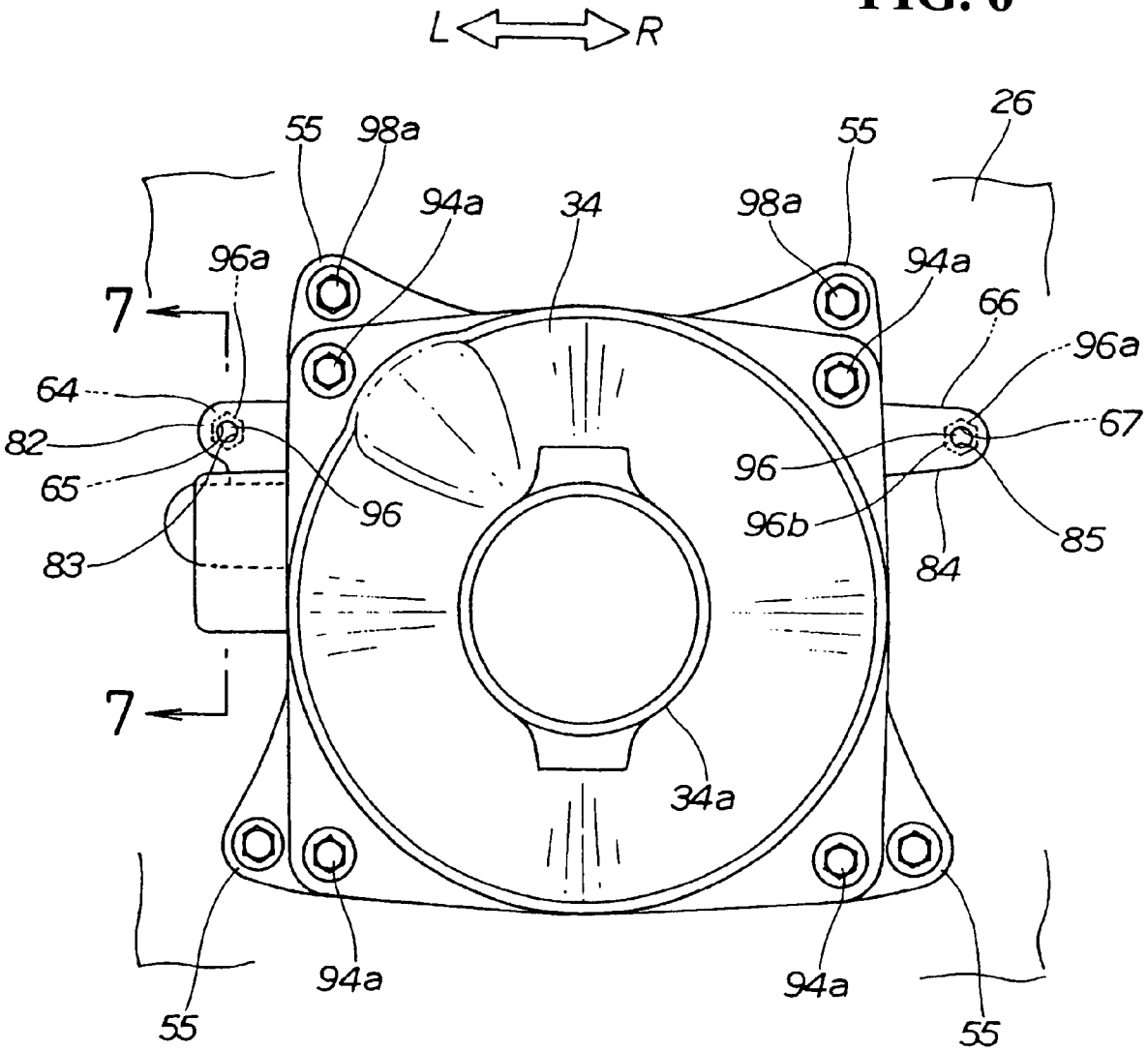
FIG. 6 is a rear view showing the water jet propeller according to the preferred embodiment of the present invention.

FIG. 5 is a side elevational view showing the water jet propeller according to the preferred embodiment of the present invention. FIG. 6 is a rear view showing the water jet propeller according to the preferred embodiment of the present invention. The front end portion 32*b* of the stator 32 is pressed up against the rear end portion 30*a* of the impeller housing 30. Furthermore, the front end portion 34*b* of the nozzle 34 is pressed up against the rear end portion 32*a* of the stator 32.

In this condition, the connection bolts 94 are inserted into the mounting holes 92 in the nozzle 34, the mounting holes 74 and the mounting holes 72 in the stator 32, and the mounting threaded holes 58 in the impeller housing 30. The threaded portions 94*b* of the connection bolts 94 are then screwed in the corresponding ones of the mounting threaded holes 58. The stator 32 is thereby clamped between the impeller housing 30 and the nozzle 34. The impeller housing 30, the stator 32 and the nozzle 34 are then connected together using the four connection bolts 94.

In this condition, the head portions 94*a* of the connection bolts 94 are disposed to face rearwardly of the hull 11 (see FIG. 1). Connecting together the impeller housing 30, the stator 32 and the nozzle 34 brings the water guide path 62 into communication with the water take-out path 78.

In addition, connecting together the impeller housing 30, the stator 32 and the nozzle 34 causes the left-hand side first protruding tab 82 and the left-hand side second protruding tab 64 to oppose each other. Similarly, connecting together the impeller housing 30, the stator 32 and the nozzle 34 causes the right-hand side first protruding tab 84 and the right-hand side second protruding tab 66 (see FIG. 6) to oppose each other.

The lock bolt (second bolt) 96 is inserted in the mounting hole 65 (see FIG. 7) in the left-hand side second protruding tab 64. The threaded portion 96*b* protruding from the left-hand side second protruding tab 64 is then screw-threadably engaged with the mounting threaded hole 83 (see FIG. 7) in the left-hand side first protruding tab 82. Specifically, the left-hand side first protruding tab 82 and the left-hand side second protruding tab 64 are connected together with the lock bolt 96.

Furthermore, referring to FIG. 6, the lock bolt (second bolt) 96 is inserted in the mounting hole 67 in the right-hand side second protruding tab 66. The threaded portion 96*b* protruding from the right-hand side second protruding tab 66 is then screw-threadably engaged with the mounting threaded hole 85 in the right-hand side first protruding tab 84. Specifically, the right-hand side first protruding tab 84 and the right-hand side second protruding tab 66 are connected together with the lock bolt 96.

Thus, the left-hand side first protruding tab 82 and the left-hand side second protruding tab 64 are connected together with the lock bolt 96, and the right-hand side first protruding tab 84 and the right-hand side second protruding tab 66 are connected together with the lock bolt 96. The impeller housing 30 and the stator 32 are thereby connected together with the two lock bolts 96, 96.

In this condition, the head portions 96*a*, 96*a* of the lock bolts 96, 96 are disposed to face forwardly of the hull 11 (see FIG. 1). The reasons why the impeller housing 30 and the stator 32 are connected together with the two lock bolts 96, 96 will be described later in detail with reference to FIGS. 8 and 9.

In a condition, in which the impeller housing 30, the stator 32, and the nozzle 34 are integrated together, the mounting brackets 55 of the impeller housing 30 are pressed against the first and the second bases 27, 28 (see FIG. 2). Mounting bolts 98 are then inserted in the mounting holes 56 in the mounting brackets 55. Threaded portions 98*b* of the mounting bolts 98 protruding from the mounting brackets 55 are then screw-threadably engaged with threaded holes (not shown) in the first and the second bases 27, 28.

The impeller housing 30, the stator 32, and the nozzle 34 are thereby mounted to the first and the second bases 27, 28 with the mounting bolts 98. In this condition, the mounting bolts 98 are disposed such that head portions 98*a* thereof face rearwardly of the hull 11 (see FIG. 1). The head portions 94*a* of the connection bolts 94 are disposed to face rearwardly of the hull 11 (see FIG. 1). This arrangement allows the connection bolts 94 to be removed and reinstalled simply and in a trouble-free manner by simply attaching a removal tool onto the head portions 94*a* of the connection bolts 94 from a rearward direction of the hull 11.

Similarly, the head portions 98*a* of the mounting bolts 98 are disposed to face rearwardly of the hull 11 (see FIG. 1). This arrangement allows the mounting bolts 98 to be removed and reinstalled simply and in a trouble-free manner by simply attaching a removal tool onto the head portions 98*a* of the mounting bolts 98 from a rearward direction of the hull 11.

Similarly, the head portions 96*a*, 96*a* of the lock bolts 96, 96 are disposed to face forwardly of the hull 11 (see FIG. 1). This arrangement makes the head portions 96*a*, 96*a* of the lock bolts 96, 96 invisible from the rear when the removal tool is mounted on the head portions 94*a* of the connection bolts 94 or the head portions 98*a* of the mounting bolts 98 from the rearward direction of the hull 11.

The arrangement, in which the head portions 96*a*, 96*a* of the lock bolts 96, 96 are invisible from the rear, prevents the lock bolts 96, 96 from being inadvertently removed.

Figure 7:
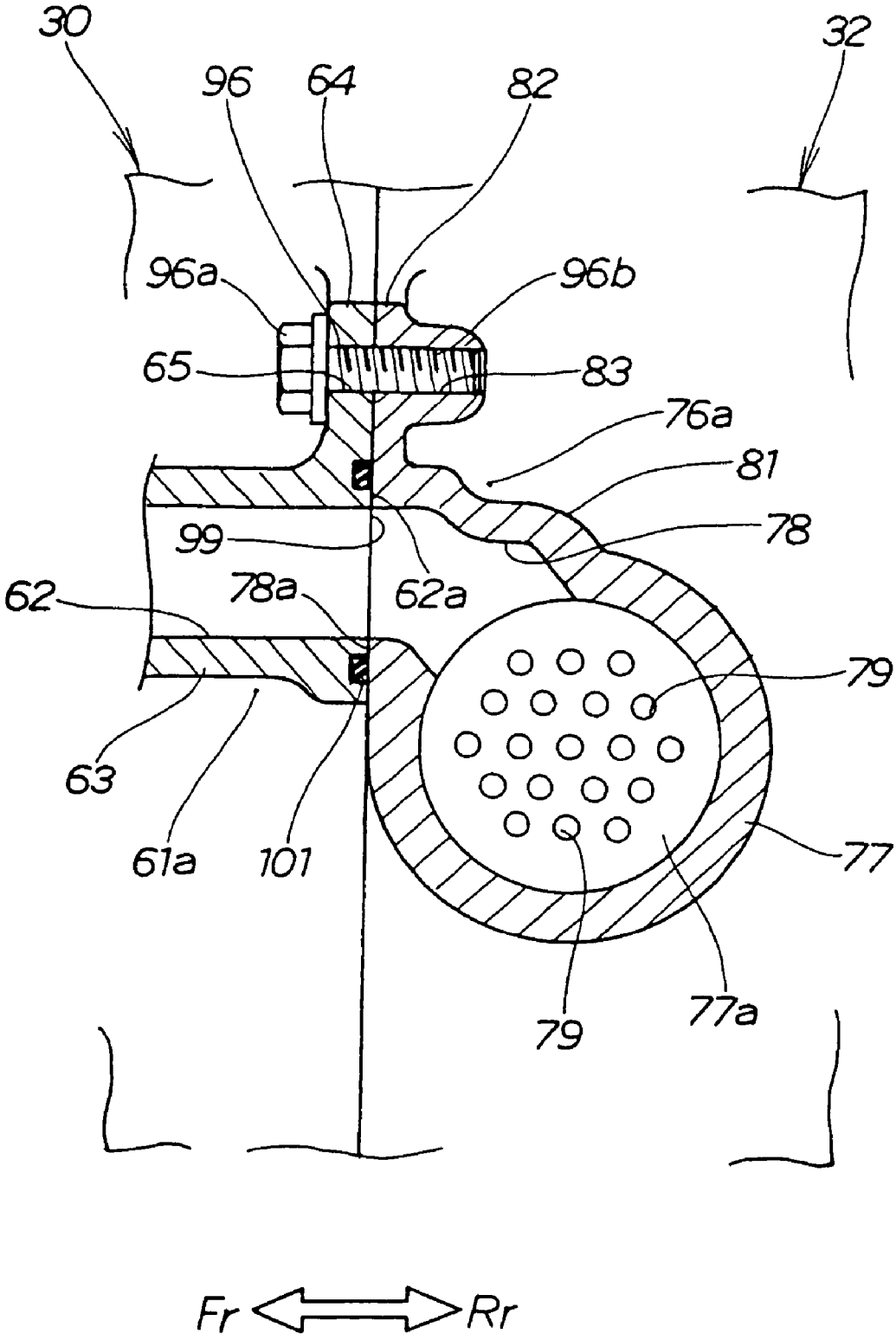
FIG. 7 is a cross-sectional view taken along line 7-7 of FIG. 6.

FIG. 7 is a cross-sectional view taken along line 7-7 of FIG. 6. The lock bolt 96 is inserted in the mounting hole 65 in the left-hand side second protruding tab 64. The threaded portion 96*b* protruding from the left-hand side second protruding tab 64 is then screw-threadably engaged with the mounting threaded hole 83 in the left-hand side first protruding tab 82. The lock bolt 96 is tightened with the left-hand side second protruding tab 64 being opposed to the left-hand side first protruding tab 82.

It should be noted herein that the left-hand side second protruding tab 64 is formed integrally with the wall portion 63 of the water guide path 62 and the left-hand side first protruding tab 82 is formed integrally with the wall portion 81 of the water take-out path 78.

Accordingly, the lock bolt 96 is tightened with the left-hand side second protruding tab 64 and the left-hand side first protruding tab 82 being opposed to each other. The lock bolt 96 is therefore tightened in a condition, in which the opening end 78*a* of the water take-out path 78 and the rear opening end 62*a* of the water guide path 62 are in abutment with each other by way of the left-hand side second protruding tab 64 and the left-hand side first protruding tab 82.

This achieves a positive sealing of an abutment portion (connection portion) 99 between the opening end 78*a* of the water take-out path 78 and the rear opening end 62*a* of the water guide path 62 using a sealing material 101.

The water take-out path 78 is in communication with a space 77*a* of the water take-out portion 77. The space 77*a* is in communication with the stator 32 via small holes 79. Accordingly, water in the stator 32 is led into the space 77*a* via the small holes 79 and the water led into the space 77*a* is guided to the water guide path 62 via the water take-out path 78.

The reasons why the impeller housing 30 and the stator 32 are connected together with the two lock bolts will be described in detail below with reference to FIGS. 8 and 9.

Figure 8:
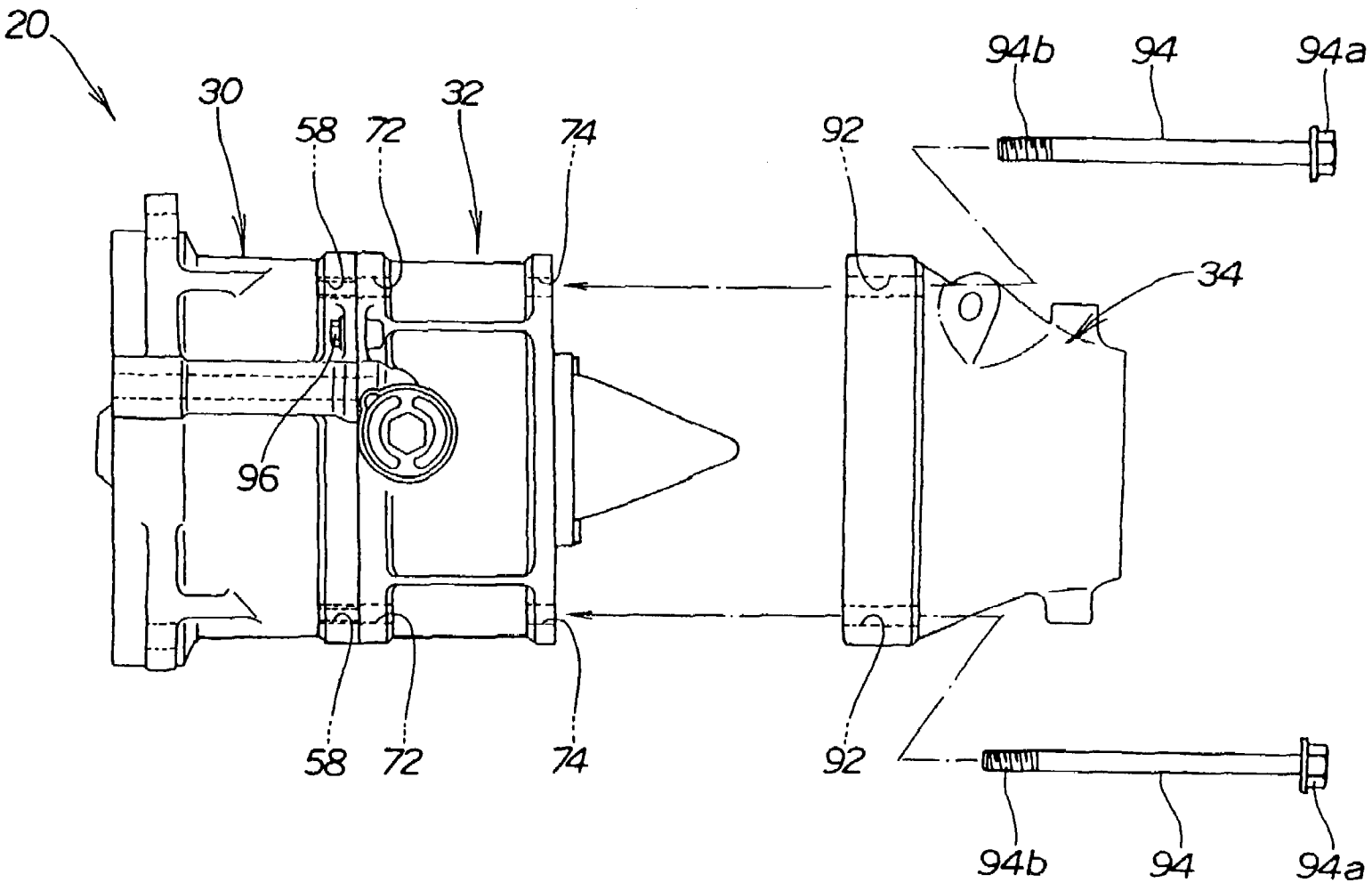
FIG. 8 is a view for illustrating a condition, in which connection bolts are removed from the water jet propeller according to the preferred embodiment of the present invention.

FIG. 8 is a view for illustrating a condition, in which the connection bolts are removed from the water jet propeller according to the preferred embodiment of the present invention. A threaded connection is made between the impeller 36 of the water jet propeller 20 and the support shaft 42 (see FIG. 2). The support shaft 42 is then rotatably mounted in the stator 32. The impeller 36 is then accommodated in the impeller housing 30.

In this condition, the impeller housing 30 and the stator 32 are connected integrally using the lock bolts 96, 96. Accordingly, when the connection bolts 94 are removed to separate the water jet propeller 20, a condition, in which the impeller housing 30 and the stator 32 are connected together, is retained.

Accordingly, a condition, in which the impeller 36 is stored inside the impeller housing 30, is retained, thus preventing the impeller 36 from being exposed.

Figure 9:
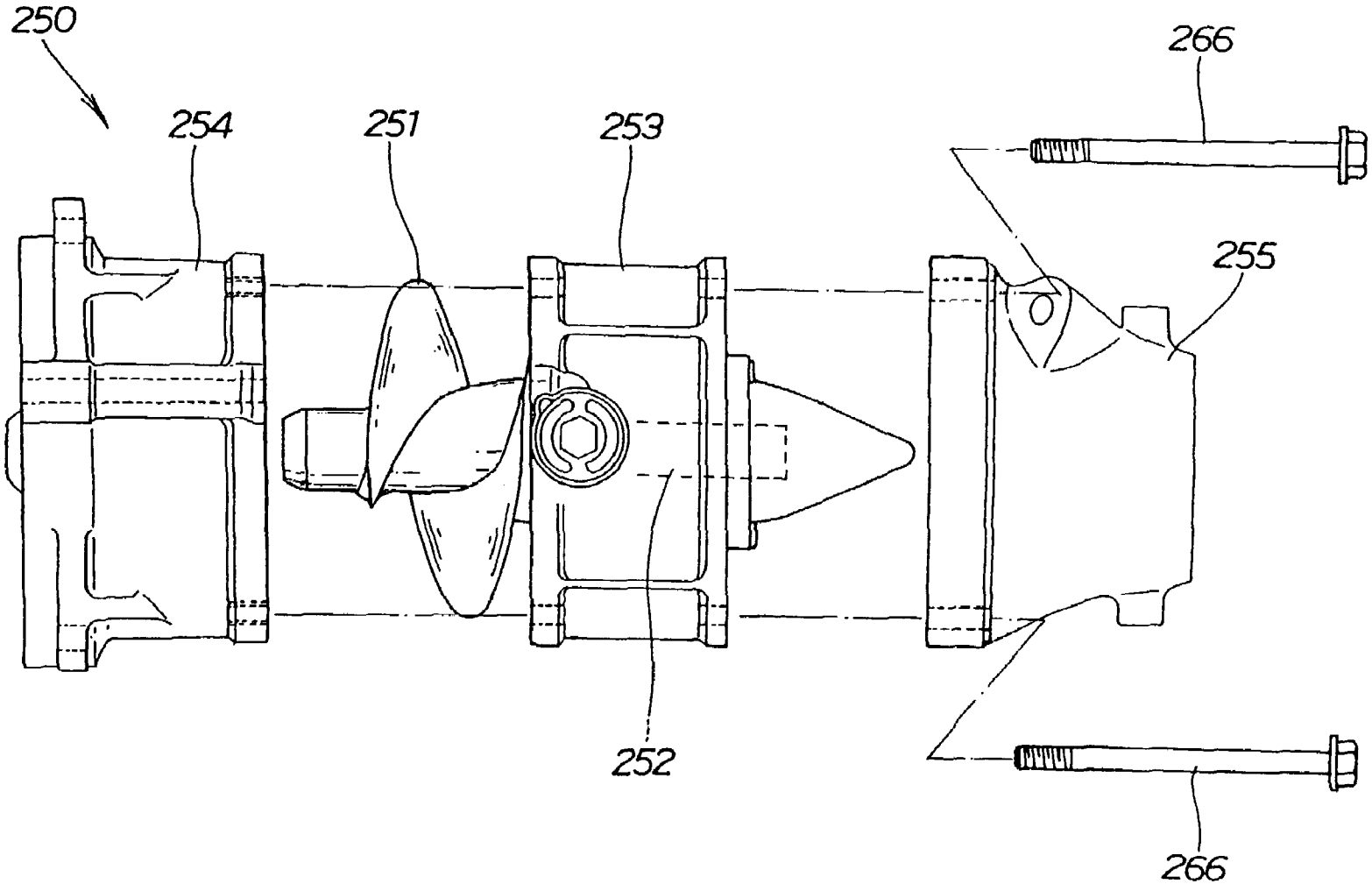
FIG. 9 is a view for illustrating a condition, in which connection bolts are removed from a water jet propeller according to a modified example of the present invention.

FIG. 9 is a view for illustrating a condition, in which connection bolts are removed from a water jet propeller according to a modified example of the present invention. A threaded connection is made between an impeller 251 of a water jet propeller 250 and a support shaft 252. The support shaft 252 is then rotatably mounted in a stator 253. The impeller 251 is then accommodated in an impeller housing 254. In this condition, the impeller housing 254, the stator 253, and a nozzle 255 are connected integrally together using connection bolts 266.

When the connection bolts 266 are removed to separate the water jet propeller 250, therefore, the impeller housing 254 is separated from the stator 253. As a result, the impeller housing 254 is separated from the impeller 251, thus exposing the impeller 251.

An example, in which the personal watercraft is propelled by the water jet propeller, will be described with reference to FIG. 10.

Figure 10:
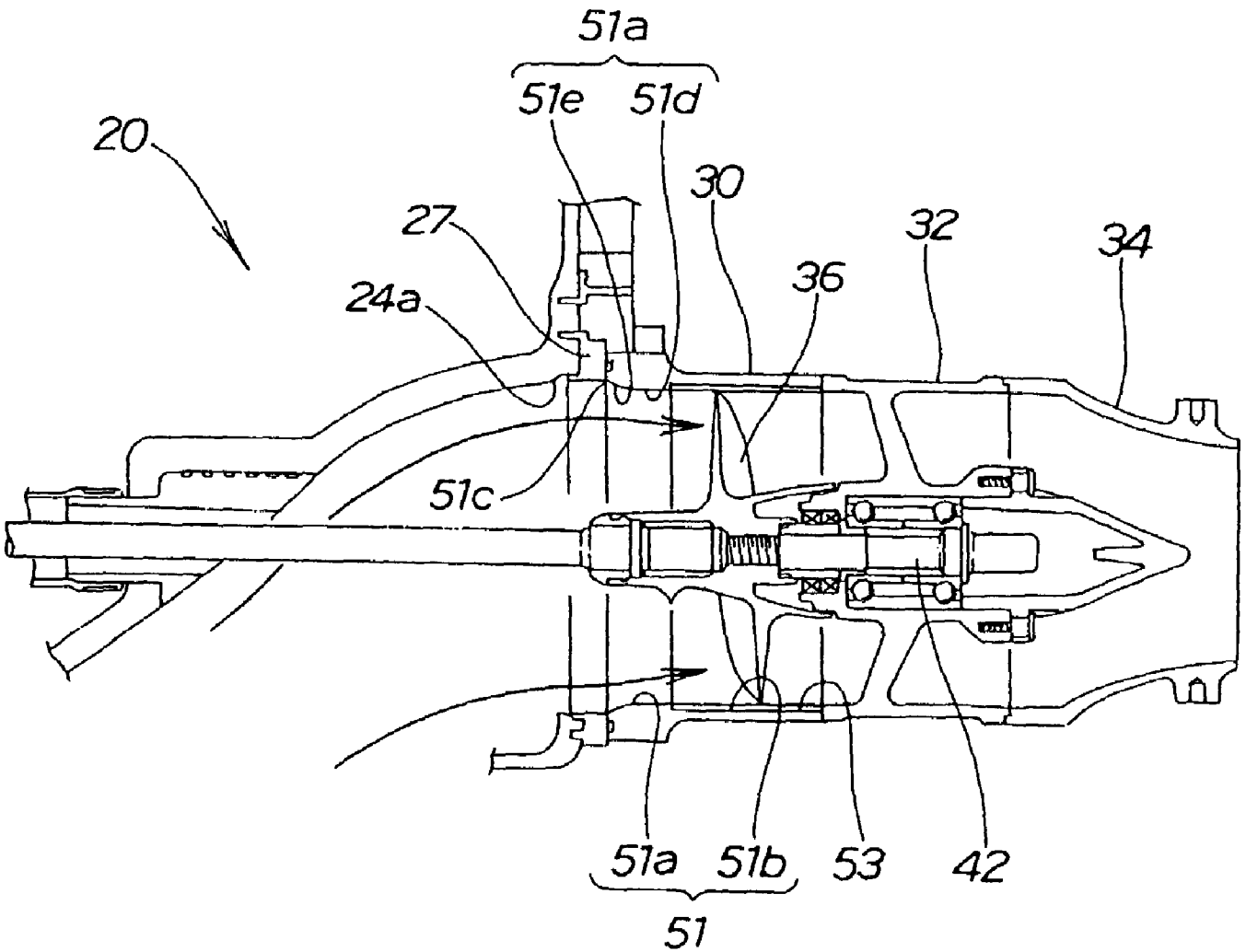
FIG. 10 is a view for illustrating the operation of the water jet propeller according to the preferred embodiment of the present invention.
Figure 11:
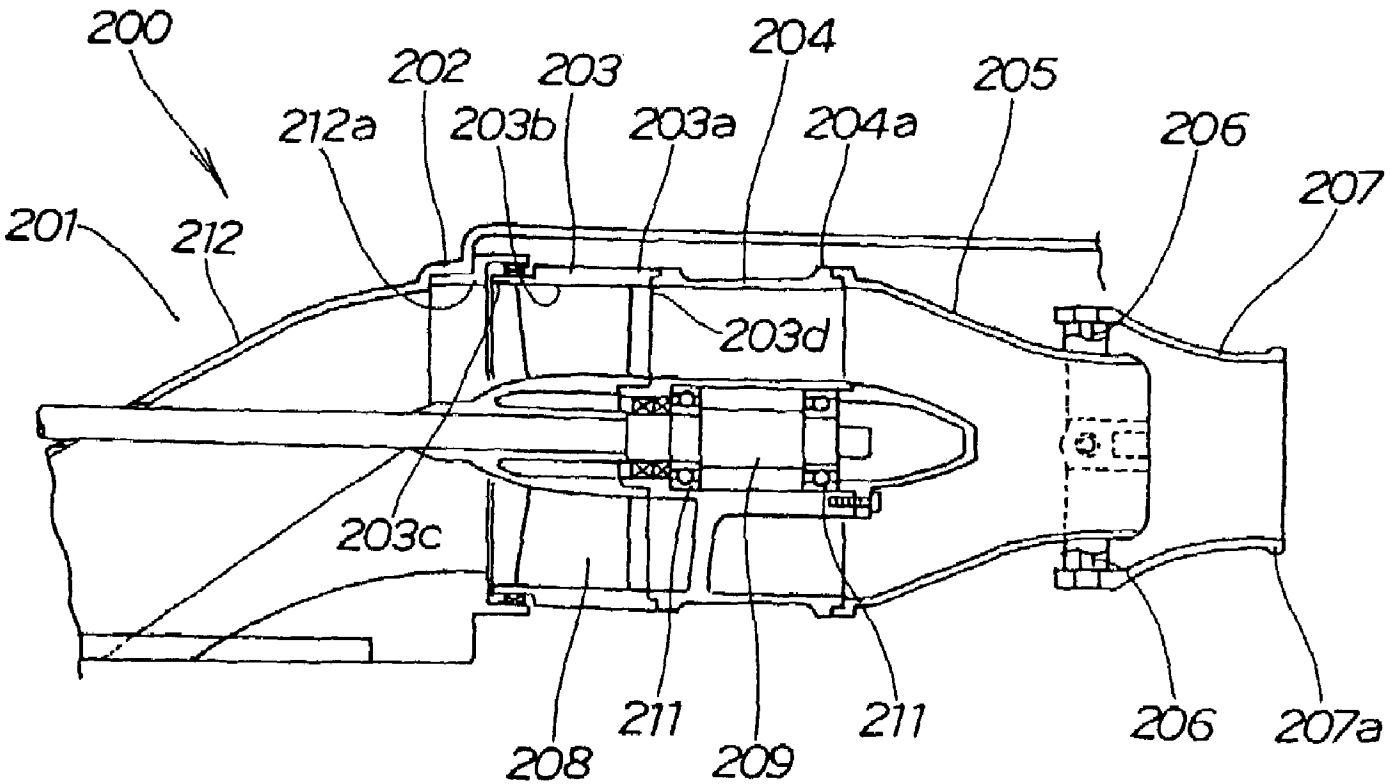
FIG. 11 BACKGROUND ART
FIG. 11 is a view for illustrating a basic construction of a water jet propeller according to the background art.

FIG. 10 is a view for illustrating the operation of the water jet propeller according to the preferred embodiment of the present invention. The water jet propeller 20 includes the liner 53 that is applied to the region 51*b* facing the impeller 36 and representing the inner periphery 51 of the impeller housing 30, except for the front end portion 51*a*.

The inside diameter of the region 51*e* on the front edge side, of the front end portion 51*a* not lined with the liner 53, is made to increase gradually toward the front edge 51*c*. The region 51*e* on the front edge side is thus formed into a curved cross section. In addition, the region 51*d* located immediately before the liner 53 is formed to have an inside diameter that is identical to the inside diameter of the liner 53. The front edge 51*c* of the inner periphery 51 is formed to have an inside diameter identical to the inside diameter of the first base 27 and the inside diameter of the rear end portion 24*a* of the water flow duct 24.

Accordingly, even if the inside diameter of the liner 53, of the inner periphery 51 of the impeller housing 30, is made smaller than the inner periphery of the rear end portion 24*a* of the water flow duct 24, no step is formed in the first base 27, the rear end portion 24*a* of the water flow duct 24, and the front edge 51*c* of the inner periphery 51. This permits an efficient inflow of water in the direction shown by the arrow in FIG. 10 from the rear end portion 24*a* of the water flow duct

24 to the impeller housing 30 by way of the first base 27 and the front end portion 51*a* of the inner periphery 51.

It is easily conceivable that the inner periphery 51 of the impeller housing 30 wears from rotation of the impeller 36. The water jet propeller 20 therefore includes the stainless steel liner 53 that is applied to the region 51*b* facing the impeller 36 and representing the inner periphery 51 of the impeller housing 30, except for the front end portion 51*a*. This enhances wear resistance of the region 51*b* facing the impeller 36 and representing the inner periphery 51 of the impeller housing 30, except for the front end portion 51*a*.

The water jet propeller according to the preferred embodiment of the present invention described heretofore includes the liner 53 molded (insert-molded) in the impeller housing 30. The present invention is not limited to the aforementioned embodiment. For example, the same effects can be achieved by the liner 53 press-fitted in the impeller housing 30.

According to the preferred embodiment of the present invention described heretofore, the front end portion 51*a* includes the region 51*d* located immediately before the liner 53 and the region 51*e* located on the side adjacent to the front edge 51*c*. The region 51*e* on the side adjacent to the front edge 51*c* (that is, part of the front end portion 51*a*) has an inside diameter that gradually increases toward the front. The present invention is not limited to the aforementioned embodiment. Rather, the same effects can be achieved even if the inside diameter of the entire region of the front end portion 51*a* is made to gradually increase toward the front, or toward the front edge 51*c*.

Furthermore, according to the preferred embodiment of the present invention described in the foregoing, the region 51*e* on the side adjacent to the front edge 51*c* has an inside diameter that gradually increases toward the front, thereby forming into a curved cross section. It is nonetheless possible to form the region 51*e* into a tapered cross section.

The present invention can be preferably applied to a water jet propeller having an impeller disposed inside an impeller housing and making the impeller rotate to expel a water jet.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water jet propeller, comprising:

an impeller housing disposed in a rear portion of a hull, the impeller housing including a front end portion formed to have an inside diameter that gradually increases forwardly, and a rear portion formed to have an inside diameter having a substantially constant diameter;

an impeller disposed inside the impeller housing, said impeller being disposed so as to circumvent a front end portion of an inner periphery of the impeller housing;

a cylindrically shaped stator disposed at a rear end portion of the impeller housing; and a nozzle disposed at a rear end portion of the stator, the nozzle having a diameter that gradually diminishes rearwardly, wherein the impeller housing includes a liner disposed over a region facing the impeller, the liner forming the inner periphery of the impeller housing, except for the front end portion thereof, the liner having a substantially constant inner diameter, and the jet propeller propels the hull by expelling a water jet from a rear end portion of the nozzle using water that flows in from a water flow duct forward of the impeller housing by rotating the impeller, and wherein the impeller housing includes a plurality of mounting brackets formed on an outer perimeter of the front end portion thereof and a rear flange formed on the rear end portion thereof, the plurality of mounting brackets for mounting the impeller housing to the hull, and the rear flange for mounting the impeller housing to the stator.

2. The water jet propeller according to claim 1, wherein a region having an inside diameter identical to the inside diameter of the liner is formed immediately before the liner at the front end portion.

3. The water jet propeller according to claim 2, wherein the liner is insert-molded in the impeller housing.

4. The water jet propeller according to claim 1, wherein the liner is insert-molded in the impeller housing.

5. The water jet propeller according to claim 1, wherein the impeller housing includes a water guide path formed on an outer surface thereof, said water guide path being in communication at one end with a water take-out path formed in the stator.

6. A water jet propeller, comprising:

an impeller housing;

a stator mounted to a rear end portion of the impeller housing;

a nozzle mounted to a rear end portion of the stator, said nozzle having a diameter that gradually diminishes rearwardly; and an impeller mounted inside the impeller housing, said impeller extending from the rear end portion of the impeller housing toward a front end portion of the impeller housing, wherein the impeller housing includes a liner disposed over a region of an inner periphery of the impeller housing that faces the impeller, the liner extending from the rear end portion of the impeller housing toward the front end portion of the impeller housing to the same extent as the impeller, the front end portion of the impeller housing is formed to have an inside diameter that gradually increases forwardly, and the liner having a substantially constant inner diameter, and wherein the impeller housing includes a plurality of mounting brackets formed on an outer perimeter of the front end portion thereof and a rear flange formed on the rear end portion thereof, the plurality of mounting brackets for mounting the impeller housing to a hull, and the rear flange for mounting the impeller housing to the stator.

7. The water jet propeller according to claim 6, wherein a region having an inside diameter identical to the inside diameter of the liner is formed immediately before the liner at the front end portion.

8. The water jet propeller according to claim 7, wherein the liner is insert-molded in the impeller housing.

9. The water jet propeller according to claim 6, wherein the liner is insert-molded in the impeller housing.

10. The water jet propeller according to claim 6, wherein the impeller housing includes a water guide path formed on an outer surface thereof, said water guide path being in communication at one end with a water take-out path formed in the stator.

* * * * *